US011491668B2

(12) United States Patent
Psimadas et al.

(10) Patent No.: US 11,491,668 B2
(45) Date of Patent: Nov. 8, 2022

(54) PROTECTOR FOR A RAZOR CARTRIDGE, A SHAVING ASSEMBLY, A WET SHAVING RAZOR, AND A METHOD OF USING SUCH A WET SHAVING RAZOR

(71) Applicant: BIC-VIOLEX S.A., Anixi (GR)

(72) Inventors: Ioannis-Marios Psimadas, Vrilissia-Athens (GR); Efstratios Christofidellis, Kifisia (GR); Andreas Vasiliadis, Chalandri-Athens (GR); Panagiotis Giannopoulos, Ilion (GR)

(73) Assignee: BIC-VIOLEX SA, Anixi (GR)

( * ) Notice: Subject to any disclaimer, the term of this patent is extended or adjusted under 35 U.S.C. 154(b) by 308 days.

(21) Appl. No.: 15/736,101

(22) PCT Filed: Jul. 16, 2015

(86) PCT No.: PCT/EP2015/066242
§ 371 (c)(1),
(2) Date: Dec. 13, 2017

(87) PCT Pub. No.: WO2017/008856
PCT Pub. Date: Jan. 19, 2017

(65) Prior Publication Data

US 2018/0169879 A1 Jun. 21, 2018

(51) Int. Cl.
*B26B 21/40* (2006.01)
*B26B 21/42* (2006.01)
*B26B 21/14* (2006.01)

(52) U.S. Cl.
CPC ..... *B26B 21/4037* (2013.01); *B26B 21/14* (2013.01); *B26B 21/42* (2013.01)

(58) Field of Classification Search
CPC ..... B26B 21/4037; B26B 21/42; B26B 21/22; B26B 21/222; B26B 21/225;
(Continued)

(56) References Cited

U.S. PATENT DOCUMENTS 1,633,139 A * 6/1927 Staats-Oels ..... B26B 21/22 30/50
2,171,880 A 9/1939 Lewis
(Continued)

FOREIGN PATENT DOCUMENTS

WO 2012/028171 A1 3/2012
WO 2012/028413 A1 3/2012

OTHER PUBLICATIONS

International Search Report for PCT/EP2015/066242 dated Mar. 2, 2016.

*Primary Examiner* — Clark F Dexter
(74) *Attorney, Agent, or Firm* — Polsinelli PC

(57) ABSTRACT

A protector for a razor cartridge is provided. The protector includes a housing extending longitudinally along a longitudinal axis and having a front face and a rear face. The protector further is provided with a first comb disposed on the front face and a second comb opposite the first comb. The protector also includes a first trimming blade has a first cutting edge and a second trimming blade opposite the first trimming blade has a second cutting edge. The first comb and the second comb have several teeth projecting along an axis that is oblique to the longitudinal axis defining a trimming length. The trimming length is adjustable. The teeth of the first comb protrude forwardly with respect to the first cutting edge and the teeth of the second comb protrude forwardly with respect to the second cutting edge.

15 Claims, 9 Drawing Sheets

(58) Field of Classification Search
CPC ..... B26B 21/227; B26B 21/4006; B26B 21/4043; B26B 21/14
USPC ..... 30/81, 82, 50
See application file for complete search history.

(56) References Cited

U.S. PATENT DOCUMENTS

| | | | | |
|---|---|---|---|---|
| 2,623,278 | A * | 12/1952 | Elliott | B26B 21/42 30/30 |
| 2010/0011586 | A1 | 1/2010 | Nicoll et al. | |
| 2017/0266826 | A1* | 9/2017 | Kole et al. | B26B 21/02 |
| 2019/0134833 | A1* | 5/2019 | Kole et al. | B26B 21/42 |
| 2020/0290223 | A1* | 9/2020 | Kole et al. | B26B 21/227 |

* cited by examiner

PROTECTOR FOR A RAZOR CARTRIDGE, A SHAVING ASSEMBLY, A WET SHAVING RAZOR, AND A METHOD OF USING SUCH A WET SHAVING RAZOR

CROSS REFERENCE TO RELATED APPLICATION

This application is a National Stage application of International Application No. PCT/EP2015/066242, filed on Jul. 16, 2015, the entire contents of which is incorporated herein by reference.

BACKGROUND

1. Field

The disclosure relates to protectors for razor cartridges, to razor assemblies including a razor cartridge and a protector, to a wet shaving razor having a razor handle and such an assembly, to a method of using such a wet shaving razor, and to a method of manufacturing such a protector. In particular, the disclosure relates to the manner to protect a razor cartridge and to shave the hair. The disclosure further relates to the manner to trim the hair to a given length.

As detailed herein, "razor cartridge" means a "shaving cartridge" or a "trimming cartridge." A shaving cartridge allows for traditional shaving, whereas a trimming cartridge allows for trimming, for example a shaving which is more precise than the traditional one. Additionally, "razor blade" means a "shaving blade" or a "trimming blade." A shaving blade allows for traditional shaving, whereas a precision trimming blade allows for trimming, for example a shaving process which is more precise than the traditional one. Also, trimming, as detailed herein, is to leave the hair at a certain length. According to some aspects, trimming is also called grooming. Grooming is the action of cutting hair at a desired length. Grooming can also be defined as the shaping of hair in terms of different (geometrical) shapes but also keeping hair looking healthy and clean.

2. Description of Related Art

Generally, protectors are provided onto razor cartridges to protect the cartridge from dust, cutting, etc.

For instance, typically, a safety razor includes a razor blade head, a handle carrying a handle head at one end and a shield for overlying razor blade head.

However, typical shields or protectors are limited to only a protective function and are released from the razor cartridge before shaving.

Additionally, some protectors include combs. Combs give access to the razor blades provided on the razor cartridge, and are generally used to provide the shave with a given length.

Protectors that are provided with a comb lose their protective function because the razor blades provided on the razor cartridge are at least partially accessible through the teeth of the comb.

Some protectors are provided with both a comb and a trimming blade and cover the razor blades in order to protect them; however, these types of protectors do not allow a change in the trimming length. The comb and the trimming blade are motionlessly secured together such that the trimming length is non-adjustable by the user.

Hence, current protectors do not allow both protecting the razor blades while also allowing for trimming to a given length. Additionally, known protectors do not allow both protecting the razor blades while allowing trimming to a given length to be adjustable by the user.

SUMMARY

According to aspects of the disclosure, a protector and a method are provided which may allow for both protection of the razor blades and trimming of hair to an adjustable given length with a sole protector.

The protector may include a housing extending longitudinally along a longitudinal axis and having a front face and a rear face and being provided with a comb and a trimming blade. The trimming blade and the comb may be provided onto the front face. The trimming blade may include an elongated cutting edge and the comb may include several teeth projecting obliquely to the longitudinal axis along an oblique axis. Each of the teeth may have a height that defines a trimming length, wherein the trimming length may be adjustable.

The protector, according to some aspects, may allow for the adjustment of at least two different trimming lengths on a single protector. In other words, the user may not need to change the protector in order to have a second trimming length.

The elongated cutting edge of the trimming blade may be parallel to the longitudinal axis or may be tilted with respect to the longitudinal axis. In other words, the oblique axis may be perpendicular to the longitudinal axis or intersect the longitudinal axis to an angle that is different from 90°.

The protector may further allow for the protection of the razor blades of the razor cartridge while also allowing for hair to be trimmed to a given length. One should understand that the adjustability of the trimming length may allow the user to trim at a desired length.

According to various aspects of the disclosure, one and/or more of the following features may be incorporated in the protector alone or in combination:

- the teeth of the comb, used for trimming, may protrude forwardly with respect to the cutting edge;
- the teeth may be perpendicular to the longitudinal axis and wherein the teeth may protrude forwardly with respect to the housing;
- the protector may further be provided with a forward skin contacting surface located forward the trimming blade and a rearward skin contacting surface located rearward the trimming blade, the trimming blade may be inclined with respect to a plane tangent to the rearward skin contacting surface;
- the trimming blade may be fixedly (meaning fixed and motionless) and unreleasably mounted on the housing; the trimming blade may be mounted by a rivet(s) on the housing;
- the protector may further include a cover located on the front face of the housing, the comb may be provided on the cover and the trimming blade may be located between the cover and the front face of the housing,
- the cover may be movable with respect to the housing,
- the teeth of the comb may have a height varying along the oblique axis,
- the protector may include a first comb and a second comb, a first trimming blade having a first cutting edge and a second trimming blade having a second cutting edge, the first and the second combs may be opposite one another with respect to the longitudinal axis, the teeth of the first comb may protrude forwardly with regard to the first cutting edge and the teeth of the second comb may protrude forwardly with regard to the second cutting edge, the value of the height of the teeth of the first comb may be different from the value of the height of the teeth of the second comb, the first trimming blade and the second trimming blade may be provided on a single double edge trimming blade, the rear face of the protector may be provided with a rear opening through which the connecting members of a razor cartridge covered by the protector may be accessible for the connection to a razor handle.

Aspects of the disclosure may also involve a shaving assembly including a razor cartridge and a protector. The razor cartridge may have one or more razor blades, each provided with a cutting edge, and the protector may be able to cover at least the cutting edge of the razor blades.

According to various aspects of the disclosure, one and/or more of the following features may be incorporated in the shaving assembly alone or in combination:

the protector may have an opening allowing the protector to be mounted on the razor cartridge to cover the razor cartridge; the protector may have an opening through which the protector may be slidable over the razor cartridge to cover the razor cartridge; the protector may have an opening through which the protector may be snap-fitted on the razor cartridge to cover the razor cartridge the protector may cover the razor cartridge, the trimming blade, and more specifically, may be parallel to or tilted with respect to the one or more razor blades.

The disclosure may also involve a wet shaving razor having a razor handle and a shaving assembly. The razor cartridge may be able to be attached to the razor handle. The razor handle may extend through the rear opening of the protector when the protector is mounted onto the razor cartridge and when the razor handle is attached to the razor cartridge.

According to further aspects of the disclosure, one and/or more of the following features may be incorporated in the razor alone or in combination:

the razor handle may extend through the rear opening when the protector is slid onto the razor cartridge and when the razor handle is attached to the razor cartridge;

the razor handle may extend through the rear opening when the protector is snap-fitted onto the razor cartridge and when the razor handle is attached to the razor cartridge;

the razor cartridge may be pivotally attached to the razor handle;

the razor handle may extend longitudinally along a longitudinal direction, the longitudinal direction being perpendicular to the longitudinal axis of the protector;

the razor handle may include a lock and release mechanism to attach a razor cartridge onto the razor handle or to release a razor cartridge attached to the razor handle;

the razor cartridge may be permanently or detachably attached to the razor handle;

the razor cartridge may be pivotally or non-pivotally attached to the razor handle.

The disclosure may involve a method of using a razor wherein the user may use the above mentioned razor, selectively either in a shaving manner in which the protector may be removed from the razor cartridge and the razor cartridge may be used for shaving, or in a trimming manner in which the protector may cover the razor cartridge and the trimming blade may be used for trimming body hair. This method may also allow the user to adjust the trimming length by changing the height of the teeth in front of the cutting edge of the trimming blade.

The disclosure may further involve a method of manufacturing a protector including a housing extending longitudinally along a longitudinal axis and having a front face and a rear face, the protector being provided with a comb and a trimming blade, the trimming blade and the comb being provided onto the front face, the trimming blade having an elongated cutting edge and the comb having several teeth projecting obliquely to the longitudinal axis along an oblique axis and protruding forwardly with regard to the cutting edge, each of the teeth having a height that defines a trimming length, the method including the steps of:

providing a securing pins member comprising securing pins;

providing a trimming blade having trimming blade apertures in alignment with the securing pins;

mounting the trimming blade onto the securing pins member, the securing pins passing through the trimming blade apertures; and forming a crimping head at one end of each securing pin, thereby irremovably riveting the trimming blade onto the securing pins member.

The method may further include the steps of:

providing a securing apertures member having securing apertures in alignment with the securing pins and mounting the securing pins member onto the trimming blade, the securing pins passing through the securing apertures and forming a crimping head at one end of each securing pin, thereby irremovably riveting both the trimming blade and the securing apertures member onto the securing pins member;

providing a securing apertures member having securing apertures in alignment with the securing pins and mounting the securing pins member onto the trimming blade, the securing pins passing through the securing apertures and forming a crimping head at one end of each securing pin, thereby irremovably riveting both the trimming blade and the securing apertures member onto the securing pins member;

providing a spacer having holes in alignment with the securing pins, mounting the spacer onto the trimming blade, the securing pins passing through the holes and forming a crimping head at one end of each securing pin, thereby riveting together the trimming blade and the spacer onto the securing pins member, molding the comb in a high polished surface mold cavity;

riveting the trimming blade and the securing apertures member onto the securing pins member by fixedly attaching together the trimming blade, the securing apertures member and the securing pins member; and riveting the trimming blade and the securing apertures member onto the securing pins member by fixedly attaching together the trimming blade and the securing pins member, and movably attaching the trimming blade and the securing pins member onto the securing apertures member.

BRIEF DESCRIPTION OF THE DRAWINGS

Other characteristics and advantages of the disclosure will readily appear from the following description, provided as non-limitative examples, in reference to the accompanying drawings.

In the drawings.

On the different Figures, the same reference signs designate identical or similar elements.

DETAILED DESCRIPTION OF THE DISCLOSURE

Figure 1A:
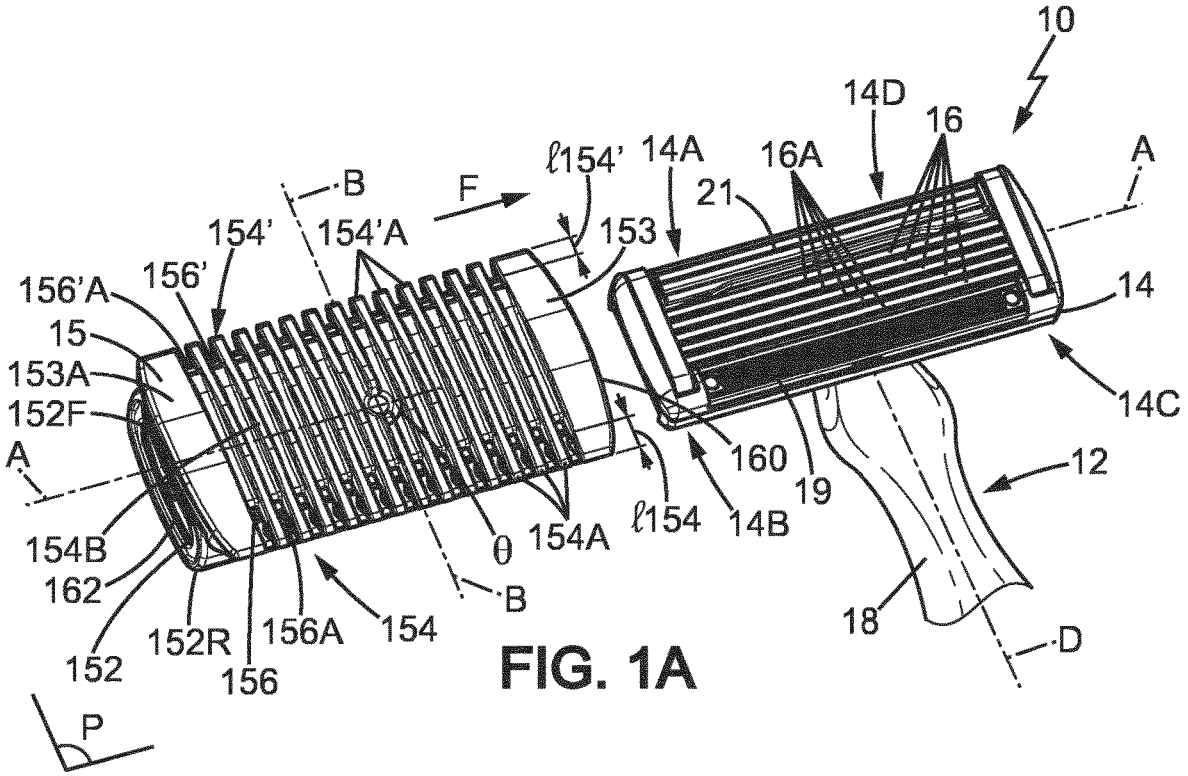
FIG. 1A is a perspective view of a wet shaving razor according to an embodiment of the disclosure with the protector being released.
Figure 2:
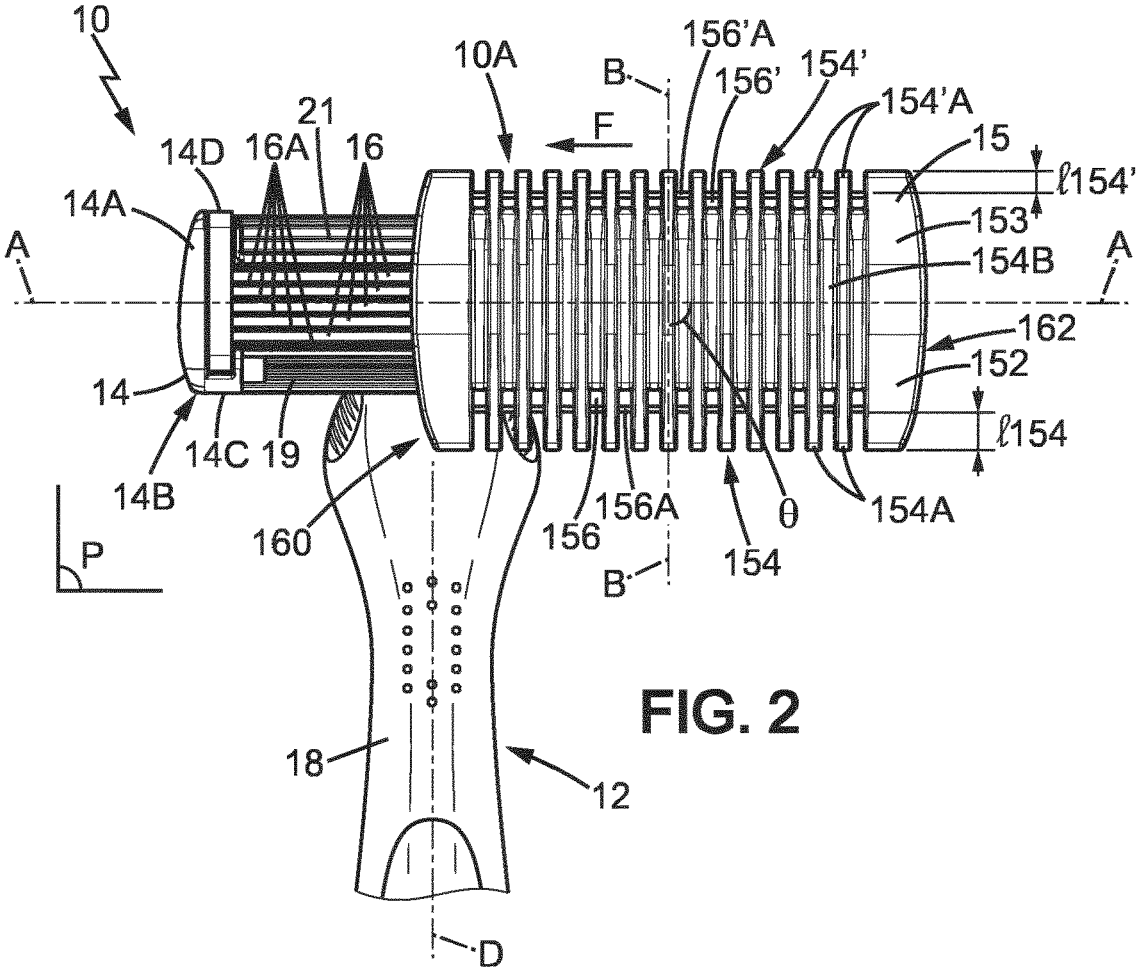
FIG. 2 is a perspective view of a wet shaving razor according to another embodiment of the disclosure with the protector being partially released.
Figure 3:
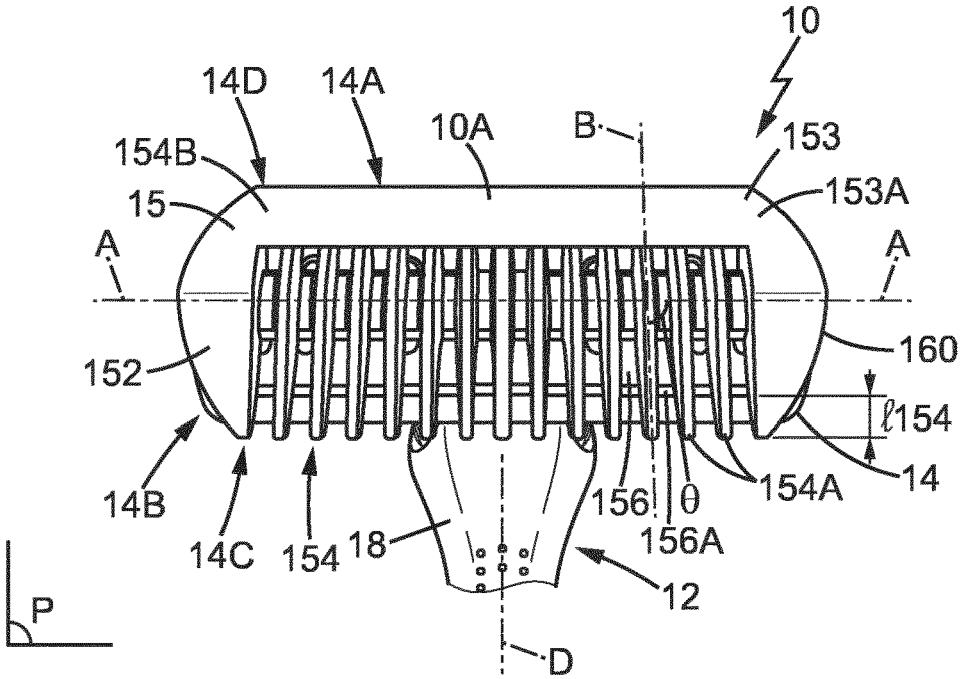
FIG. 3 is a perspective view of a wet shaving razor according to another embodiment of the disclosure with the protector being attached to the razor cartridge.

FIGS. 1A, 2 and 3 illustrate three different aspects of a wet razor 10 according to the disclosure. The razor 10 may include a razor handle 12, a razor cartridge 14 and a protector 15 which may cover the razor cartridge 14.

The razor cartridge 14 may be provided with one or more razor blades 16 which may be movably or fixedly retained in the housing of the razor cartridge 14. For instance, as illustrated on FIGS. 1A, 4A-4C and 5A-5C, the razor cartridge 14 may be provided with five razor blades 16, but the disclosure is not limited to only five razor blades 16. Aspects of the disclosure, as depicted on FIG. 6, shows a razor cartridge 14 provided with three razor blades 16. Each razor blade 16 may be provided with a shaving edge 16A that extend longitudinally along a longitudinal axis A.

The razor cartridge 14 may also be provided with a guard bar 19 and/or with a lubra 21. The guard bar 19 may be located in front of the forward most blade 16, whereas the lubra 21 may be located rear of the rear most blade 16.

The razor cartridge 14 may be a disposable razor cartridge and may include an upper face 14A having the one or several razor blades 16 exposed thereon, a lower face 14B which may be connected to the razor handle 12 by connecting members 28 (as best seen in FIGS. 4A-4C, 5A-5C and 6), a front face 14C, and a rear face 14D.

The razor handle 12 may include an elongated handle body 18 extending in a longitudinal direction D. The longitudinal direction D may extend along an axis which is perpendicular the longitudinal axis A.

The protector 15 may cover the razor cartridge 14 and may be releasably attached onto the razor cartridge 14. Thus, the razor cartridge 14 may be covered when the protector 15 is mounted on the razor cartridge 14 as depicted, for instance in FIG. 1B or uncovered with the protector 15, as depicted in FIG. 1A.

Figure 1B:
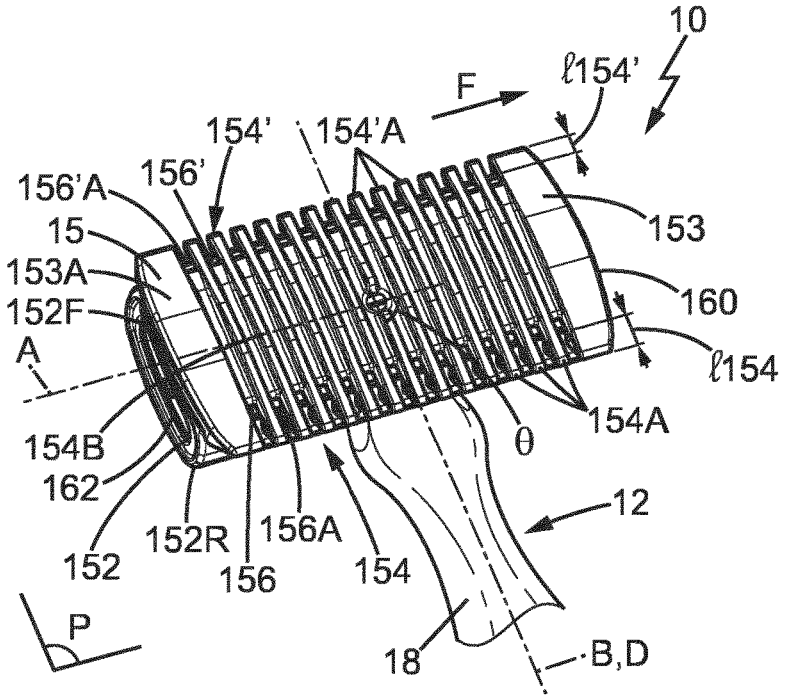
FIG. 1B is a perspective view of the wet shaving razor of FIG. 1A with the protector being mounted onto the razor cartridge.

The protector 15 may be slid onto the razor cartridge 14 as illustrated on FIGS. 1A, 1B, and 2, by sliding the protector 15 along arrow F. The protector 15 may also be attached to the razor cartridge 14 by any other way, such as for example, by snap-fitting (not illustrated).

The protector 15 may include a housing 152 extending longitudinally along the longitudinal axis A and may be provided with at least one comb 154, 154' and a corresponding trimming blade 156, 156'. The comb 154, 154' and trimming blade 156, 156' may allow the protector 15 to trim hair at a given length when the protector 15 is mounted on the razor cartridge 14. This may be particularly useful when the razor 10 used to trim, for example the bikini, as well as for trimming other trimming areas, such as for example, a beard, to a given length. The comb 154, 154' may not be detachable from the housing 152. As detailed in further details below, according to some aspects, the comb 154, 154' may be fixedly or movably attached on the housing 152. The comb 154, 154' may be movably attached by sliding the comb 154, 154' with regard to the housing 152, along the oblique axis B.

Each trimming blade 156, 156' may have an elongated cutting edge 156A, 156A'. The cutting edge 156A, 156A' of the trimming blade 156, 156' may extend parallel to the longitudinal axis A. However, the cutting edge 156A, 156A' of the trimming blade 156, 156' may extend obliquely to the longitudinal axis A.

The teeth 154A, 154'A may have a height that defines a trimming length which may be adjustable. The teeth 154A, 154'A of the comb 154, 154', usable for trimming, may protrude forwardly with respect to the cutting edge 156A, 156A'.

In order to allow the user to easily adjust the trimming length, the protector 15 may be provided with two opposed combs 154 and 154' as depicted in FIGS. 1A-1B, and FIG.

2, or with a protector 15 provided with a single adjustable comb 154 as depicted in FIG. 3.

As shown in FIGS. 4A-4D, 5A-5D, and 6, a cover 153 may be attached onto the housing 152. The cover 153 may be attached on the front face 152F of the housing 152. The cover 153 may include an upper part 153A and a lower part 153B. The combs 154, 154' may be provided on the cover 153 and the trimming blade 156 may be located between the lower part 153B of the cover 153 and the front part 152F of the housing 152. The housing 152 and the cover 153 may be manufactured in several parts assembled together by known means, such as for example, crimping, welding, etc. With the comb 154, being on the cover 153, and movable with respect to the housing 152, the cover 153 may also need to be movable with respect to the housing 152. When the comb 154 is immovable (i.e. motionless and/or secured) with respect to the housing 152, the cover 153 may also need to be immovable (i.e. motionless and/or secured) with respect to the housing 152. The attachments of the cover 153 on the housing 152 are therefore chosen in consequence.

According to some aspects, as shown in FIGS. 1A-1B and 4A-4D, the protector 15 may be provided with two opposed combs 154, 154'. Each comb 154 and 154' may include a corresponding trimming blade 156 and 156'. Each trimming blade 156 and 156' may have a cutting edge 156A and 156'A. The comb 154 may be located, for example, in the region of the front face 14C, whereas the opposed comb 154' may be located in the region, for example, of the rear face 14D. The two combs 154 and 154' may be opposed with respect to the longitudinal axis A. In other words, the teeth 154A of the first comb 154 may extend toward the front face 14C, whereas the teeth 154'A of the second comb 154' may extend toward the rear face 14D. The teeth 154'A of the second comb 154' may face opposite to the teeth 154A of the first comb 154, with respect to the longitudinal axis A. The same appears with the cutting edge 156A, 156'A of respective trimming blades 156 and 156'.

In addition, each comb 154 and 154' may be provided with teeth 154A, 154'A having a length which may be different from one comb to another. More precisely, the protector 15 may be provided with a first comb 154 having teeth 154A of a height H154 and with a second comb 154' having teeth 154'A of a height H154' which may be different from the height H154 of the first comb 154. The trimming length L may be defined as corresponding to the height of the teeth 154A, 154'A that may be usable for trimming and that may be in front of the cutting edge 156A, 156'A of the trimming blade 156, 156'. The trimming length L may be the shortest distance from the cutting edge 156A, 156'A of the trimming blade 156, 156' to a trimming plane. Therefore, the user may not be obliged to change the protector 15 to have a second trimming length available.

In order to have a second trimming length, the user may simply reverse the handle 12 to present the second comb 154' against his/her skin to trim the hairs. The user may also detach the protector 15 from the razor cartridge 14 and inverse the attachment of the protector 15 onto the razor cartridge 14 to have the second comb 154' located in the region of the front face 14C, and the opposed first comb 154 will be located in the region of the rear face 14D (FIG. 4D), to obtain the trimming length L.

Should two different trimming lengths L not be sufficient for the user, the user may use a group of several protectors 15, each protector being provided with two opposed combs 154, 154' having teeth of a height H154, H154' that is different from one protector 15 to another. The height H154, H154' of one protector 15 may be larger or smaller with respect to the height H154, H154' of another protector 15. However, the height provided on a comb 154, 154' may not vary from one tooth 154A, 154'A to another.

Figure 4A:
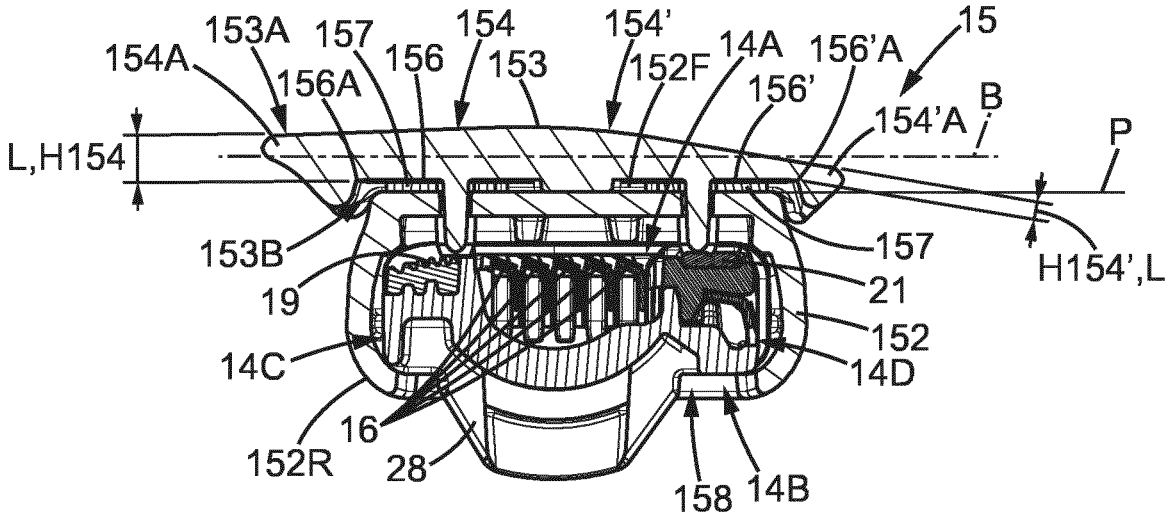
FIG. 4A is a transverse section of the shaving assembly of FIG. 1B with the razor cartridge being released from the razor handle (not illustrated) and the protector mounted on the razor cartridge.
Figure 4B:
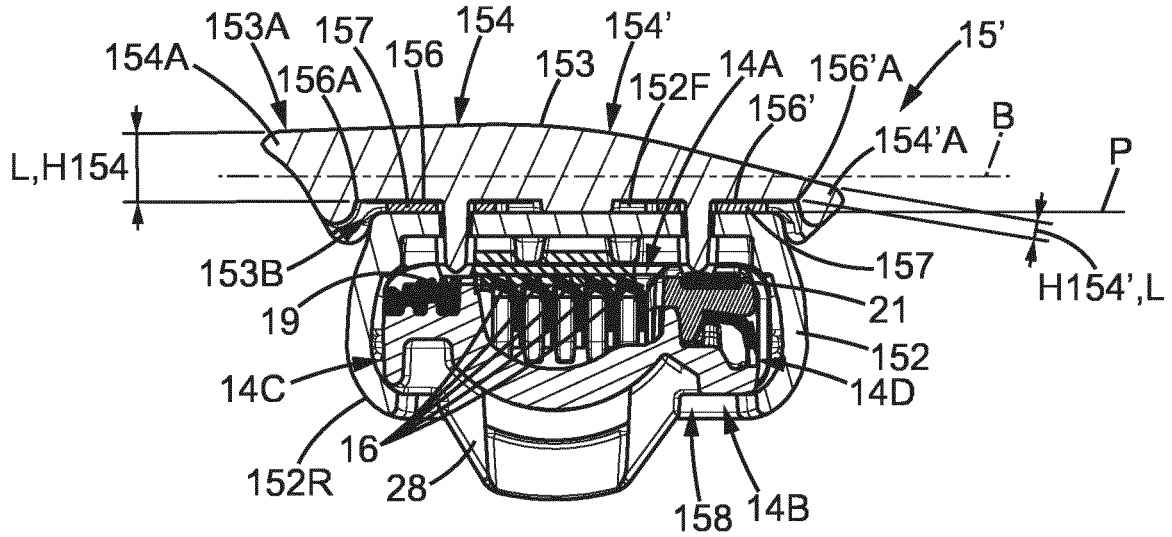
FIG. 4B is a transverse section of the shaving assembly of FIG. 1B with the razor cartridge being released from the razor handle (not illustrated) and another protector mounted on the razor cartridge.
Figure 4C:
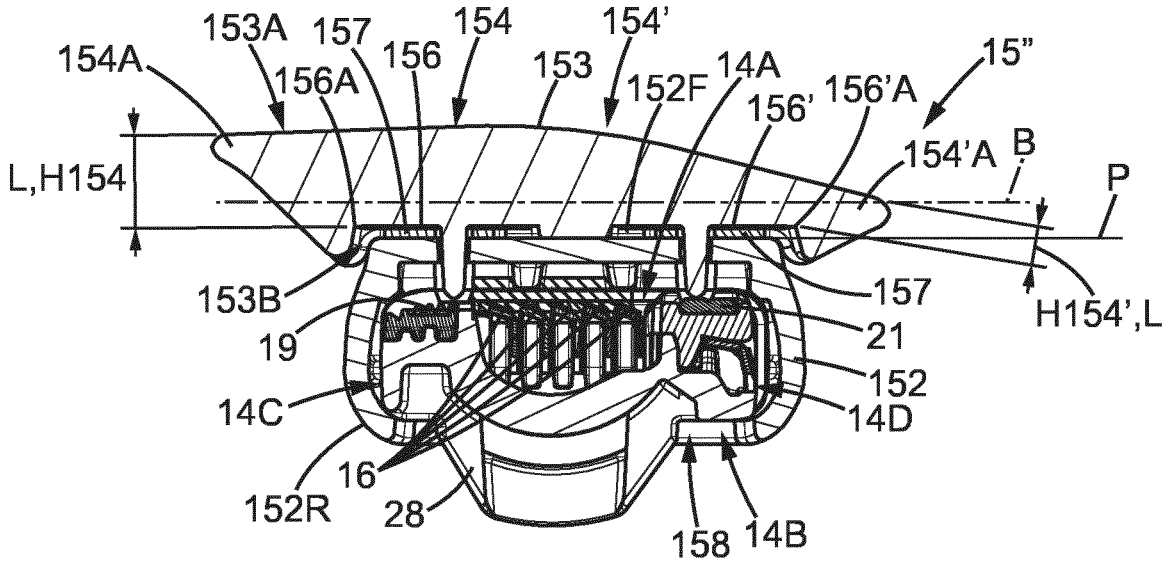
FIG. 4C is a transverse section of the shaving assembly of FIG. 1B with the razor cartridge being released from the razor handle (not illustrated) and another protector mounted on the razor cartridge.
Figure 4D:
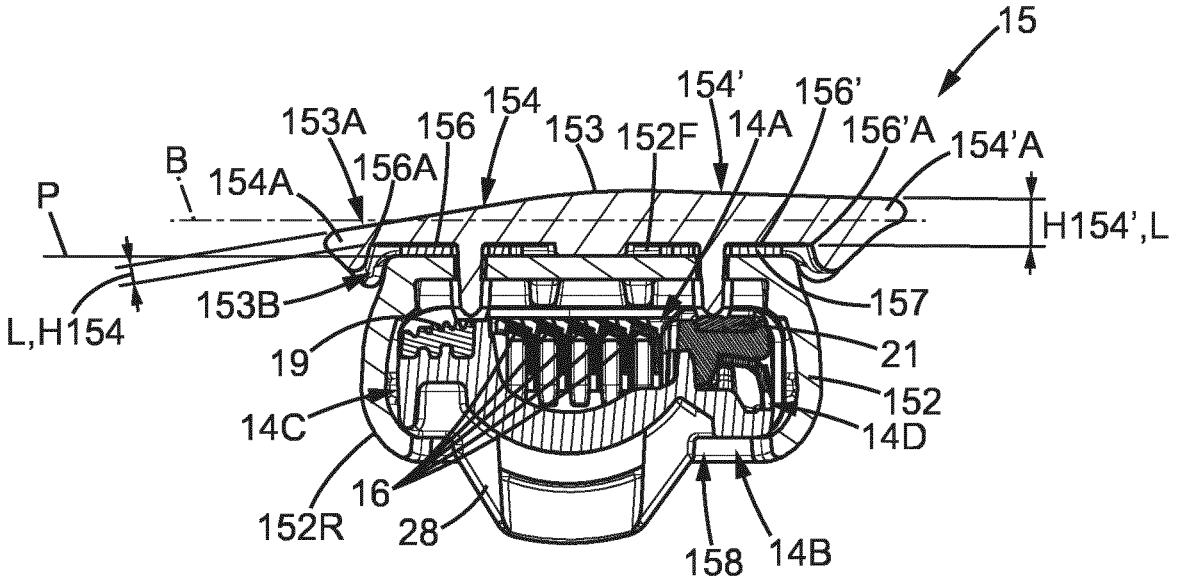
FIG. 4D is a transverse section of the shaving assembly of FIG. 1B with the razor cartridge being released from the razor handle (not illustrated) and the protector mounted inversed on the razor cartridge.

The height of the teeth 154A, 154'A may be between 0.5 mm and 20 mm, and according to some aspects, between 0.8 mm and 4 mm, and/or between 0.8 mm and 5 mm. For example, as depicted in FIGS. 4A, 4B and 4C, three different protectors 15, 15' and 15" may be attached on the razor cartridge 14 in order to have six different trimming lengths L. More than six trimming lengths L, depending on customization needs, may be provided.

According to some aspects, the cover 153 may be motionlessly fixed to the housing 152. In other words, the combs 154, 154' may not move with respect to the housing 152. Therefore, the comb 154, 154' including teeth 154A, 154'A having a height H154, when measured in front of the cutting edge 156A, 156'A of the trimming blade 156, 156', may correspond to the trimming length L.

According to other aspects, for example, the first protector 15 depicted in FIG. 4A may have a first comb 154 including teeth 154A having a height H154 of about 2 mm, whereas the second comb 154' may include teeth 154'A having a height H154' of about 0.8 mm. The second protector 15' depicted in FIG. 4B may have a first comb 154 including teeth 154A having a height H154 of about 3 mm, whereas the second comb 154' may include teeth 154'A having a height H154' of about 1 mm. The third protector 15' depicted in FIG. 4C may have a first comb 154 including teeth 154A having a height H154 of about 4 mm, whereas the second comb 154' may include teeth 154'A having a height H154' of about 2 mm.

According to other aspects, as depicted in FIGS. 2 and 5A-5D, the protector 15 may be provided with two opposed combs 154, 154'. Each comb 154 and 154' may be further provided with a corresponding trimming blade 156 and 156'. Each trimming blade 156 and 156' may have a cutting edge 156A and 156'A. The comb 154 may be, for example, located in the region of the front face 14C, whereas the opposed comb 154' may be located in the region of the rear face 14D. The two combs 154 and 154' may be opposed with respect to the longitudinal axis A. In other words, the teeth 154A of the first comb 154 may extend toward the front face 14C, whereas the teeth 154'A of the second comb 154' may extend toward the rear face 14D. The teeth 154'A of the second comb 154' may face opposite to the teeth 154A of the first comb 154 with respect to the longitudinal axis A. The same may appear with the edge 156A, 156'A of the corresponding trimming blades 156 and 156'.

Additionally, each comb 154 and 154' may be provided with teeth 154A, 154'A having a length which may be different from one comb 154, 154' to another. According to some aspects, the cover 153 may be movable with respect to the housing 152 thereby allowing a height that may vary according to the position of the cover 153 (and thus the teeth 154A, 154'A) with respect to the cutting edge 156A, 156'A of the trimming blade 156, 156'.

According to some aspects, the teeth 154A of the first comb 154 may have a height H154A that may vary along the oblique axis B.

According to other aspects, the teeth 154'A of the second comb 154' may have a height H154'A that may vary along the oblique axis B.

More precisely, the protector 15 may be provided with a first comb 154 having teeth 154A of a height H154 and with a second comb 154' having teeth 154'A of a height H154' which may be different from the height H154 of the first comb 154. The trimming length L may correspond to the height of the teeth 154A, 154'A that may be usable for trimming and that is in front of the cutting edge 156A, 156'A of the trimming blade 156, 156'. Therefore, since the protector 15 may be provided with two combs 154, 154' having different trimming lengths L, the user may not be obliged to change the protector 15 in order to have a second trimming length L.

According to some aspects, to obtain a second trimming length L, the user may have several options: the user may adjust the trimming length by moving the position of the first comb 154 or the user may reverse the handle 12 to present the second comb 154' against his/her skin to trim hairs. The user may also use the second comb 154' by detaching the protector 15 from the razor cartridge 14 and inversely attaching the protector 15 onto the razor cartridge 14 in order to have the second comb 154' located in the region of the front face 14C, whereas the opposed first comb 154 will be located in the region of the rear face 14D (FIG. 5D).

According to other aspects, for example, when two different trimming lengths L may not be sufficient for the user, the user may move the cover 153 along arrow T with respect to the housing 152 to change the height of the teeth 154A which may be in front of the cutting edge 156A of the trimming blade 156. The height H154 of the first comb 154 may be larger or smaller with respect to the height H154' of the second comb 154' on the same protector 15. However, the height provided on a comb 154, 154' may not vary from one tooth 154A, 154'A to another. For example, the height H154 may be larger than the height H154' of the teeth 154'A of the second comb 154'.

Figure 5A:
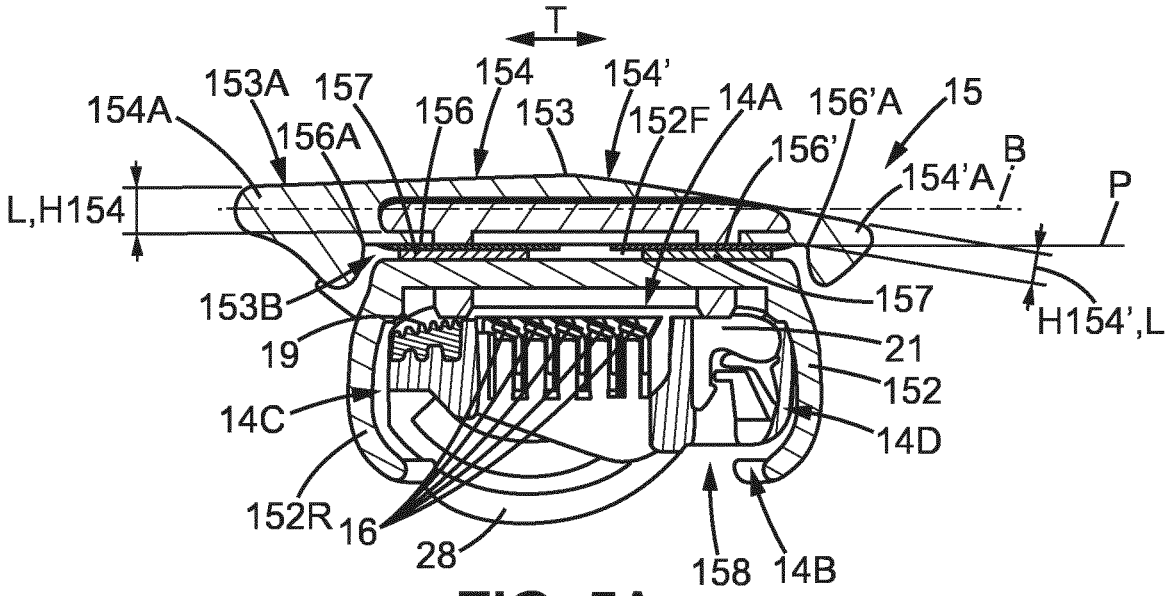
FIG. 5A is a transverse section of the shaving assembly of FIG. 2 with the razor cartridge being released from the razor handle (not illustrated) and the protector mounted on the razor cartridge in a neutral position.
Figure 6:
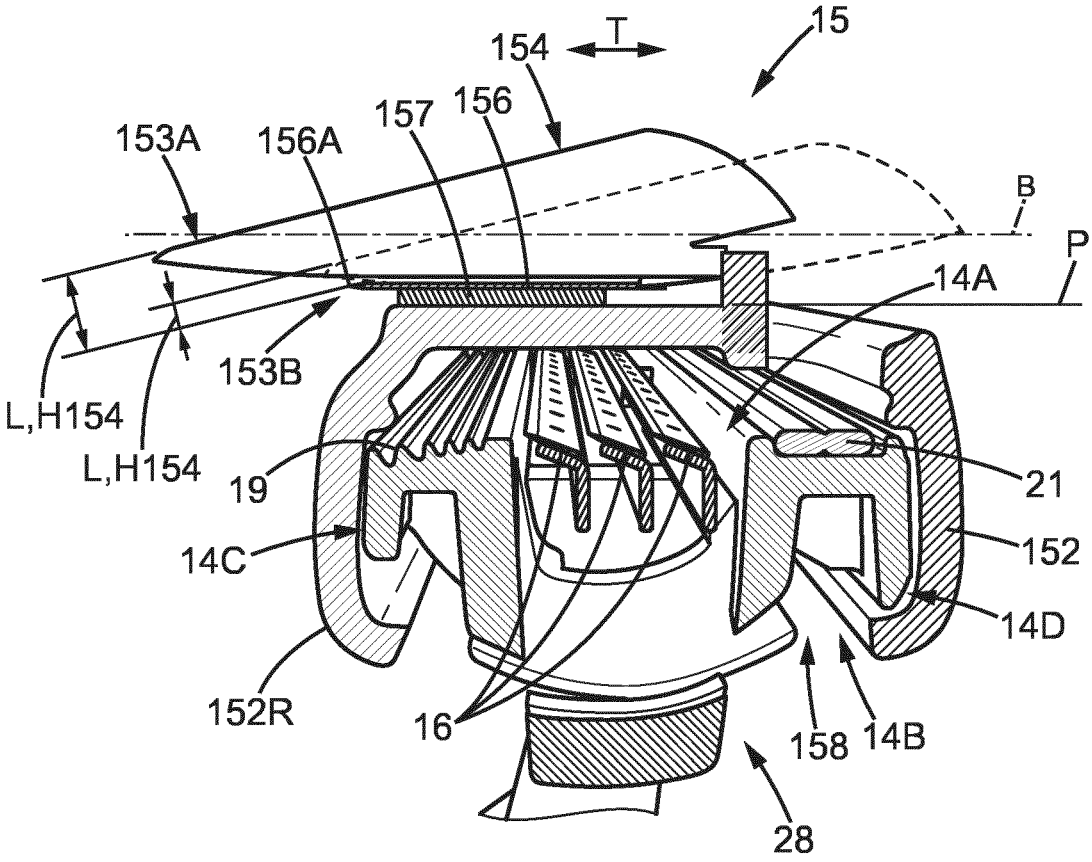
FIG. 6 is a transverse section of the shaving assembly of FIG. 3 with the razor cartridge being released from the razor handle (not illustrated) and the protector mounted on the razor cartridge in a forward position (continuous lines) or rearward position (discontinuous lines).

FIG. 5A illustrates the protector 15 in a neutral position. In a neutral position, the trimming length L of the teeth 154A of the first comb 154 and the teeth 154'A of the second comb 154' may be a medium, an intermediate length between the teeth 154A of the first comb 154 and the second comb 154'.

According to some aspects, the height of the teeth 154A, 154'A may be between about 0.5 mm and about 20 mm. However, according to other aspects, the height of the teeth 154A, 154'A may be between about 0.8 mm and about 5 mm and/or between about 0.8 mm and about 4 mm.

According to another aspect, as depicted in FIG. 5A, the trimming length L available on the side of the first comb 154 may be substantially equal to 3 mm, whereas the trimming length L available on the side of the second comb 154' may be substantially equal to 1 mm.

Figure 5B:
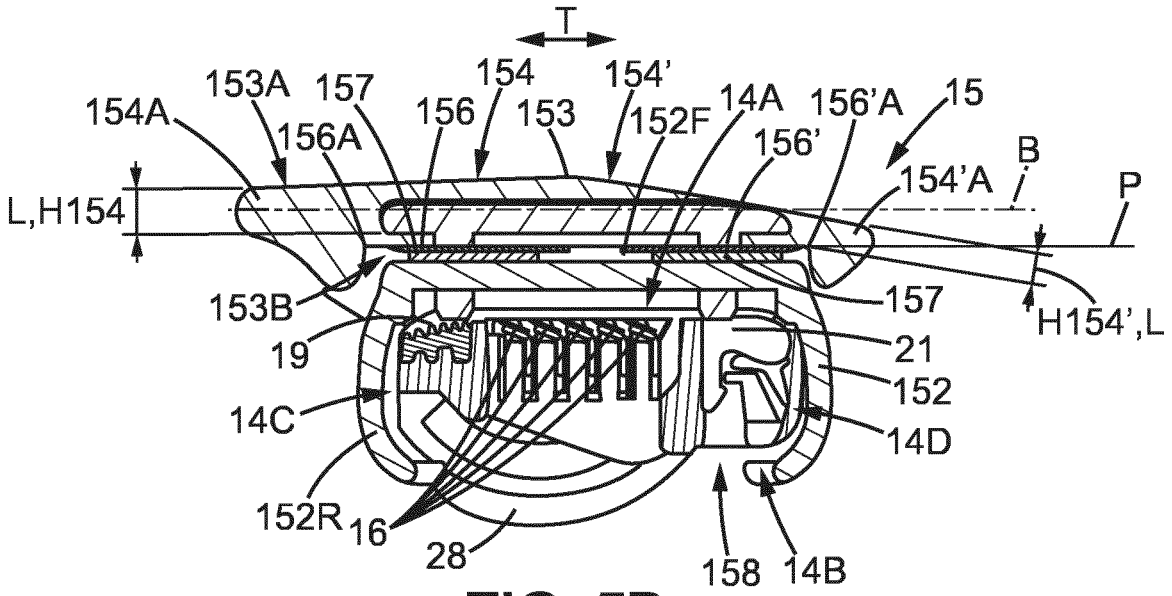
FIG. 5B is a transverse section of the shaving assembly of FIG. 2 with the razor cartridge being released from the razor handle (not illustrated) and the protector mounted on the razor cartridge in a front position.

When the cover 153 is moved frontwards along arrow T, the cover 153 may be disposed forwardly, as depicted in FIG. 5B, wherein the trimming length L of the teeth 154A of the first comb 154 may be at a maximum and the trimming length L of the teeth 154'A of the second comb 154' may be at a minimum. For example, the trimming length L available on the side of the first comb 154 may be substantially equal to 4 mm, whereas the trimming length L available on the side of the second comb 154' may be substantially equal to 0.8 mm.

Figure 5C:
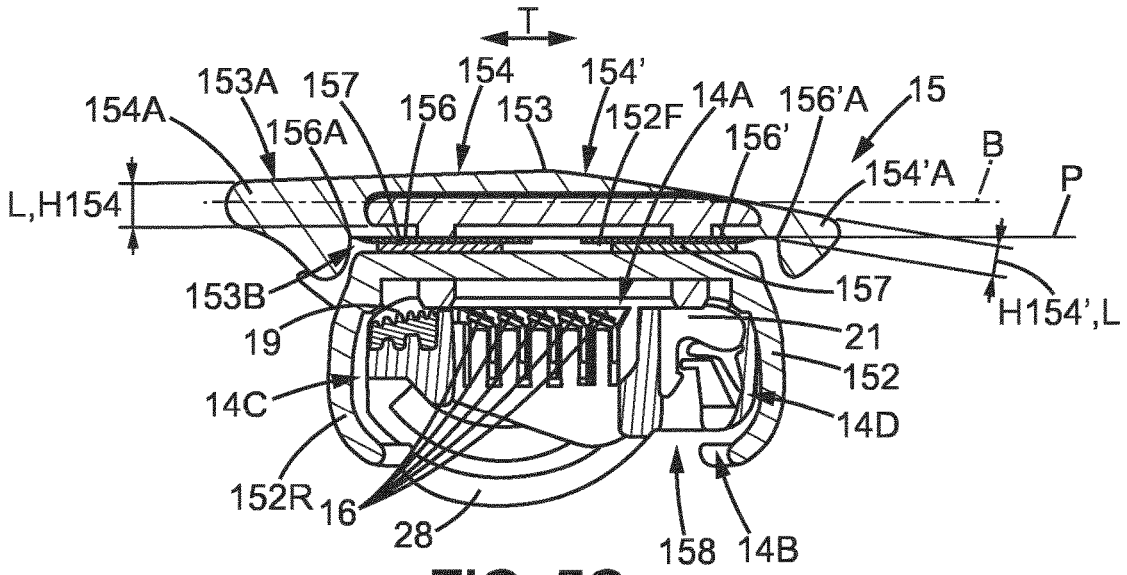
FIG. 5C is a transverse section of the shaving assembly of FIG. 2 with the razor cartridge being released from the razor handle (not illustrated) and the protector mounted on the razor cartridge in a rear position.
Figure 5D:
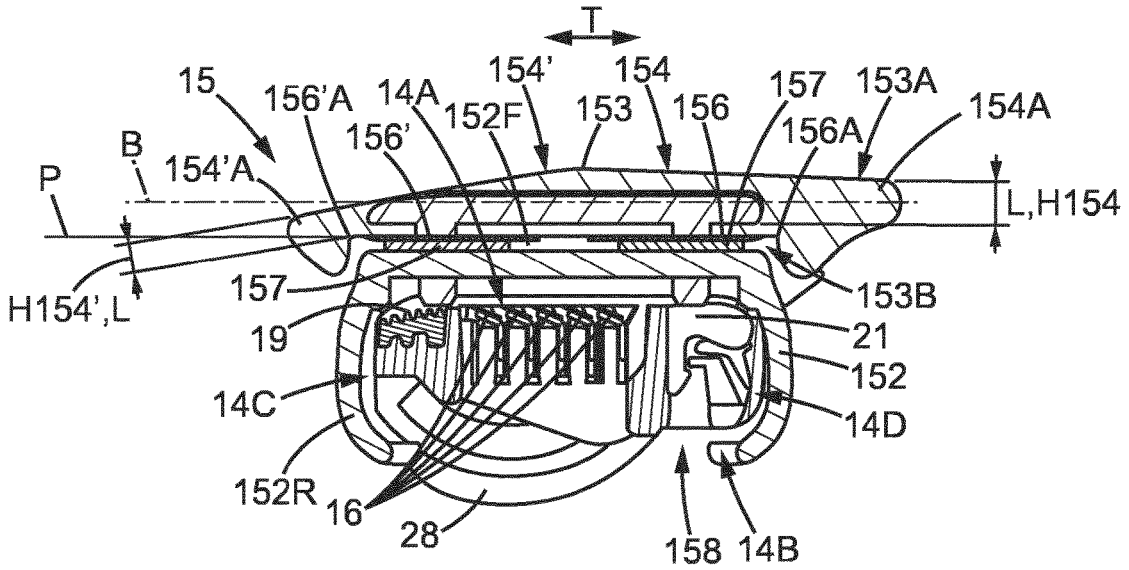
FIG. 5D is a transverse section of the shaving assembly of FIG. 2 with the razor cartridge being released from the razor handle (not illustrated) and the protector mounted on the razor cartridge in a neutral position in an opposed position with respect to FIG. 5A.

When the cover 153 is moved rearwards along arrow T, the cover 153 may be disposed rearwardly, as depicted in FIG. 5C, wherein the trimming length L of the teeth 154A of the first comb 154 may be at a minimum and the trimming length L of the teeth 154'A of the second comb 154' may be at a maximum. For example, the trimming length L available on the side of the first comb 154 may be substantially equal to 1 mm, whereas the trimming length L available on the side of the second comb 154' may be substantially equal to 1.5 mm.

Thus, by simply moving the cover 153, the user may have six different trimming lengths L available for use. Three different trimming lengths L may be available on each of the two sides of the cover 153. Each comb 154, 154' may be locked in place at a desired trimming length L and may include a locking portion (not shown). The locking portion may have a feedback indication for the user to ensure that the comb 154, 154' may be in the selected position corresponding to the desired trimming lengths L. The feedback indication may be, for example, a mechanical sound generated with the connection of the comb 154, 154' to the housing 152 wherein a sound sensory is signaled/alarmed. The feedback indication may also be a physical surface change that a user may be able to feel by touch sensory. The feedback indication may also be a label or visual indicator that may be detected by sight sensory.

In order to use the second comb 154', the user may either turn the handle body 18 or reverse the protector 15 on the razor cartridge 14, as depicted in FIG. 5D. The cover 153 may then be used in the same manner as described above.

According to other aspects, as depicted in FIGS. 3 and 6, the protector 15 may be provided with a single comb 154. The comb 154 may include a corresponding trimming blade 156 having a cutting edge 156A. The comb 154 may be, for example, located in the region of the front face 14C.

According to some aspects, the cover 153 may be movable with respect to the housing 152. This movability allows a height that may vary according to the position of the cover 153 (and thus the teeth 154A) with respect to the trimming blade edge 156A.

According to some aspects, the teeth 154A of the first comb 154 may have a height H154A that may vary along the oblique axis B.

More precisely, the trimming length L may correspond to the height of the teeth 154A, that may be usable for trimming and that may be in front of the cutting edge 156A of the trimming blade 156, that may vary according to the position of the comb 154.

Therefore, since the protector 15 may be provided with a comb 154 having different trimming lengths L, the user may not be obliged to change the protector 15 in order to have a second trimming length L. As such, the user may not be obliged to reverse the protector 15 on the razor cartridge 14.

Should the user desire to adjust the trimming length L, the user may move the cover 153 along arrow T with respect to the housing 152 to change the height of the teeth 154 which may be in front of the cutting edge 156A of the trimming blade 156. For example, the height H154 may be varied. However, the height provided on a comb 154 may not vary from one tooth 154A to another.

FIG. 6 illustrates the protector 15 in continuous lines in a forward position and the protector 15 in discontinuous lines in a rearward position. In the forward position, the trimming length L of the teeth 154A of the comb 154 may be a maximum and in the rearward position the trimming length L of the teeth 154A of the comb 154 may be a minimum. For example, the height of the teeth 154A may be between about 0.5 mm and about 20 mm. According to some aspects, the height of the teeth 154A may be between about 0.8 mm and about 4 mm and/or between about 0.8 mm and about 5 mm.

According to some aspects, the trimming length L available in the forward position may be substantially equal to 4 mm, whereas the trimming length L available in the rearward position may be equal to 1 mm. When the cover 153 is moved rearwardly along arrow T, a different trimming length L may be provided. Thus, by simply moving the cover 153, the user may have different trimming lengths L. The attachment of the cover 153 onto the housing 152 and the manner in which the cover 153 may be movable, several positions may exist for trimming when the cover 153 is positioned between the two extremes (forwardly and rearwardly). Additionally, the positions may be defined or undefined.

The teeth 154A of the comb 154 may have a height varying along the oblique axis B. The height of the teeth 154A may decrease continuously along the oblique axis B, when aligned in a direction with respect to a free edge of the teeth 154A.

According to some aspects, the number of teeth 154A may be between 5 and 15. However, according to other aspects the number of teeth may be 13. The density of the teeth 154A may be more or less important with respect to the number of teeth 154A provided on one comb 154 in relation to the dimensions of the teeth 154A. The higher the density of the teeth 154A, for example, 13 teeth for a comb 154 of about 35 mm in length along the longitudinal axis A, the easier it may be to manufacture the protectors 15, especially when manufacturing in series. More precisely, when manufactured in large quantities, the protectors 15 may be taken to a separate station where they will be attached to the razor cartridge 14. The protectors 15 may also be provided on a separate mounting station when the trimming blade(s) 156 may be mounted. While separate stations may be detailed, the assembly may all occur in the same location. Each time there is a need to manipulate the protectors 15 there may be a risk of tangling the teeth 154A of one comb 154 with the teeth 154A of another comb 154. Thus, the density of teeth 154A may be selected to avoid the need of having to have an additional manufacturing stage to detangle and align the combs 154. The tangled teeth 154A between two or more combs 154 may increase the scrap rate as tangled parts may lead to broken teeth 154A.

According to some aspects, the cover may be non-detachable from the housing 152. The cover 153 may also be fixed (meaning motionless and/or secured, i.e. fixedly attached) on the housing 152 or the cover 153 may be movably mounted on the housing 152 in order to adjust the height of the teeth 154A to a desired trimming length L.

As depicted in FIGS. 1A-1B, 2 and 3, the trimming blade 156, 156' may be elongated along the longitudinal axis A and may include an elongated cutting edge 156A, 156'A parallel to the longitudinal axis A. The trimming blade 156, 156' may be parallel to the longitudinal axis A or trimming blade 156, 156' may be inclined/tilted with respect to the longitudinal axis A (not illustrated). More precisely, the trimming blade 156 may be tilted at an angle with respect to the longitudinal axis A. The angle that the trimming blade 156 may be tilted with respect to the longitudinal axis A, for example, between about 0 degrees, wherein the trimming blade edge 156A may be parallel to the longitudinal axis A, and about 60 degrees, According to some aspects, the trimming blade 156 may be tilted with respect to the longitudinal axis A, for example, between about 0 degrees and about 45 degrees, and according to other aspects, between about 0 degrees and about 20 degrees.

According to some aspects, the comb 154, 154' may include several teeth 154A, 154'A which may project obliquely to the longitudinal axis A and which may protrude forwardly with respect to the trimming blade 156, 156'. The teeth 154A, 154'A may project obliquely to the longitudinal axis A along an oblique axis B. More precisely, the angle P between the teeth 154A and the longitudinal axis A may be 90 degrees, as shown in FIGS. 1A-1B, 2 and 3, where the teeth 154A, 154'A are perpendicular to the longitudinal axis A. The angle P between the teeth 154A, 154'A and the longitudinal axis A may be different from 90 degrees, according to other aspects, and may be between 20 degrees and 160 degrees. When considering one comb 154, the angle P may be the same for each of the teeth 154A or may vary from one tooth 154 to another. The teeth 154A may be perpendicular to the trimming blade(s) 156 or not, depending upon the value of the angle P and the value of angle between the trimming blade 156 and the longitudinal axis A. More precisely, the teeth 154A, 154'A and the trimming blade edge 156A, 156'A may be, respectively, perpendicular to the longitudinal axis A and parallel to the longitudinal axis A, or the teeth 154A, 154'A and the trimming blade edge 156A, 156'A may be tilted with respect to the longitudinal axis A.

The teeth 154A may also include an additional coating or overmolding. For example, inner walls of the teeth 154A may be provided with an additional material such as rubber to assist with increasing friction upon contact with the hair and to help alignment the hair being cut. The additional coating or overmolding may lead to a better gripping of the hair during the cut. The combs 154 may be made of a single material or of several materials.

A length 1154, 1154' of the teeth 154A, 154'A may be measured from the free edge of the teeth 154A, 154'A to the cutting edge 156A, 156'A of the trimming blade 156, 156'. The length 1154, 1154' of the teeth 154A, 154'A may be the same or may vary, for example, such as by being greater from lateral sides 152A of the housing 152 to a center of the housing 152 that may be along the longitudinal axis A (not illustrated). According to some aspects, the length 1154, 1154' of the teeth 154A, 154'A may be between about 5 mm and about 40 mm. According to other aspects, the length 1154, 1154' of the teeth 154A, 154'A may be between about 10 mm and about 30 mm and/or between about 5 mm and about 25 mm.

The housing 152 may include a front face 152F and a rear face 152R. The trimming blade 156, 156' and the comb 154, 154' may be provided onto the front face 152F. The rear face 152R may include a rear opening 158 (see FIGS. 4A-4C, 5A-5C, and 6) through which the connecting members 28 of the razor cartridge 14, covered by the protector 15, may be accessible for the connection to the razor handle 12. The razor handle 12 may extend through the opening 158 when the protector 15 is mounted (by sliding, snapping or other similar mounting techniques) onto the razor cartridge 14 and when the razor handle 12 is attached to the razor cartridge 14.

When mounted onto the razor cartridge 14, the comb 154, 154' and the trimming blade 156, 156' may be located on the front face 10A of the razor 10, opposite to the connection with the handle 12, as best seen in FIGS. 1B, 2, and 3.

The comb 154 may include the teeth 154A and a rear part 154B from which the teeth 154A may protrude forwardly. A second comb 154' may be provided on the protector 15 with teeth 154'A, wherein there may be a common rear part 154B from which the teeth 154'A may protrude forwardly (opposite to the direction of teeth 154A). Rear part 154B may be reduced to the maximum as depicted on FIGS. 1A-1B and 2 (i.e. the size of the rear part 154B may be as small as possible). The teeth 154A, 154'A may protrude forwardly with respect to the housing 152 and may extend beyond the housing 152 and the trimming blade 156, 156'.

The comb 154 may be made of a plastic material. The plastic material may be the same as the material used for the housing 152, or may be a plastic material different from the housing 152, such as for example, of a plastic material that may be softer than a plastic material used for the housing 152. The plastic used for the comb 154 may have a different color than the color used for the housing 152, or may be the same color as the housing 152.

The trimming blade 156, 156' may be disposed directly between the upper part 153A and the lower part 153B of the housing 152 (not illustrated), or as illustrated in FIGS. 4A-4C, 5A-5C, 6, and 7A-7B, a spacer 157 may be disposed directly between the trimming blade 156, 156' and the front face 152F of the housing 152.

The trimming blade 156 may be fixedly (as in motionless and/or secured) and unreleasably mounted on the housing 152, such as for example, by being rivet mounted in the housing 152 (as best seen in FIGS. 4A-4C and 7A-7B).

According to some aspects, an external surface of the cover 153 may be configured to function as a skin contacting surface and may be a highly polished (glossy) surface. The highly polished (glossy) skin contacting surface may induce a low friction coefficient between the external surface of the cover 153 and the skin, thereby promoting an efficient dry shave. The comb 154 may also be provided with a very low friction surface. A high polished surface on the mold cavity (32 μm, 16 μm or even 8 μm finish) may be used for manufacturing the comb 154, to provide the comb 154 with a low friction coefficient surface.

The trimming blade 156 may be parallel to a plane P tangent to the front face 152F of the housing 152 or may be inclined at an angle with respect to the plane P. The angle that the trimming blade 156 may be with the plane P may be, for example, between 0 and 30 degrees. The trimming blade 156 and more precisely the cutting edge 156A of the trimming blade 156 may be inclined forwardly with respect to the plane P.

According to some aspects, the protector 15 may not be provided with a connecting member allowing the connection to the razor handle 12. The protector may also be not in contact with any part of the razor handle 12. According to some aspects, the razor cartridge 14 may be pivotally connected to the razor handle 12. As such, when the protector 15 is mounted onto the razor cartridge 14, the protector 15 may also be pivotally connected to the razor handle 12 via the razor cartridge 14 and more specifically, via the connecting members 28 of the razor cartridge 14.

The location of the trimming blade 156, 156' and the cutting edge 156A, 156'A of the trimming blade 156, 156' may be chosen to provide the most manageable, stable and efficient arrangement of the protector 15 when used as a trimmer.

According to some aspects, the pivot axis (not shown) of the razor cartridge 14 may be located, for example, symmetrically in the middle of the protector 15. Such an arrangement may provide a limited range of motion of the trimming blade 156, 156' which may enhance safety by allowing a more precise control of the trimming blade 156, 156', especially in hard to reach areas. Due to the symmetrical pivot center, a shaving force applied by the user may be uniformly distributed over the entire cover 153. Also, the closer the distance of the pivot axis of the razor cartridge 14 (not shown) to the trimming blade edge 156A, 156'A and a flat surface formed by the skin contacting surface, which is above the trimming blade 156, 156', may be advantageous because the flat skin contacting surface may provide a return force that may push at the pivot axis location, thereby assisting with maintaining contact of the trimming blade 156, 156' with the skin. Additionally, the closer the distance of the pivot axis of the razor cartridge 14 (not shown) to the trimming blade edge 156A, 156'A may avoid rotation of the razor cartridge 14 thus controlling lifting of the trimming blade 156, 156' off the skin.

According to some aspect, a rear opening 158 provided in the rear face 152R of the housing 152 may lead to a lateral opening 160 provided in the lateral face 152A of the housing 152. The rear opening 158 and the lateral opening 160 may allow for the protector 15 to be slid onto the razor cartridge 14 along arrow F. An opposite lateral opening 162 may also be provided in the opposing lateral face 152A of the housing 152. The opposite lateral opening 162 may make it easier for air to escape when sliding the protector 15 onto the razor cartridge.

According to some aspects, since the protector the main razor blade(s) 16 of the razor cartridge 14, the protector 15 may be mounted on the razor cartridge 14 to form a shaving assembly usable to trim hair. When the protector 15 is completely mounted onto the razor cartridge 14, the protector may cover at least the shaving edges 16A of the razor blades 16 contained in the razor cartridge 14. According to some aspects, the protector 15 may completely cover the razor blades 16 when the protector 15 mounted onto the razor cartridge 14. Accordingly, no opening or access to the razor blades 16 may be possible through the protector 15. Therefore, the protector may completely protect the razor blades 16 and the user may not get injured by the razor blades 16.

According to further aspects, the trimming blade 156 may be elongated along the longitudinal axis A. When the protector 15 is attached onto the razor cartridge 14, the trimming blade 156, 156' may be parallel to the one or more razor blades 16. Thus, the razor blade(s) 16 may also be elongated along longitudinal axis A. According to some aspects, the razor blades 16 may be perpendicular to the longitudinal direction D of the handle body 18. As such, when the protector 15 is mounted onto the razor cartridge 14, which may be attached to the razor handle 12, the longitudinal axis A may be perpendicular to the longitudinal direction D.

According to further aspects, the length of the trimming blade 156 may be the same as the length of the razor blades 16. However, according to other aspects, and in order to have a more precise shave, length of the trimming blade 156 may be shorter than the length of the razor blades 16.

According to further aspects, the disclosure may also involve a wet shaving razor 10 having a razor handle 12 and a shaving assembly as detailed above. According to some aspects, for example, the way the protector 15 may be mounted on the razor cartridge 14, the user may have to reverse the handle body 18 in order to ensure that the comb 154 may be in a good shaving/trimming position. The protector, along with a single comb 154, may be mounted on the razor cartridge 14 with the cutting edge 156*a*. 156'A of the trimming blade 156, 156' projecting in the same direction as the shaving edge 16A of the razor blade(s) 16. According to other aspects, the comb 154 may be mounted on the razor cartridge 14 with the cutting edge 156*a*. 156'A of the trimming blade 156, 156' projecting in the opposite direction as the shaving edge 16A of the razor blade(s) 16. The protector 15 may be mounted in both directions, either in the same direction or in the opposing direction of the shaving edge 16A of the razor blade(s) 16. The attachment of the shaving assembly on the handle should be designed in consequence.

According to other aspects, a method of manufacturing a protector 15 may include the steps of:

providing a securing pin member 155' including securing pins 155, providing a trimming blade 156 having trimming blade apertures 159 in alignment with the securing pins 155, mounting the trimming blade 156 onto the securing pin member 155', passing the securing pins 155 through the trimming blade apertures 159, and forming a crimping head 155A at one end of each securing pin 155, thereby irremovably riveting the trimming blade 156 onto the securing pin member 155'.

Figure 7A:
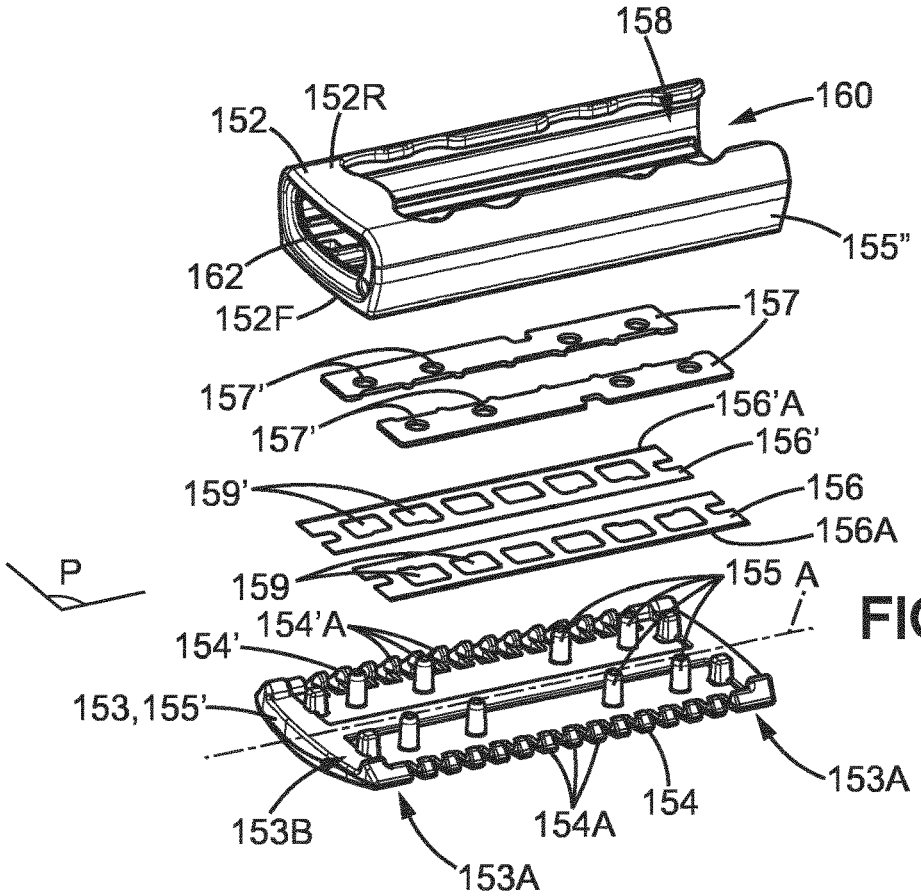
FIG. 7A is an exploded view of a protector according to an aspect of the disclosure.
Figure 7B:
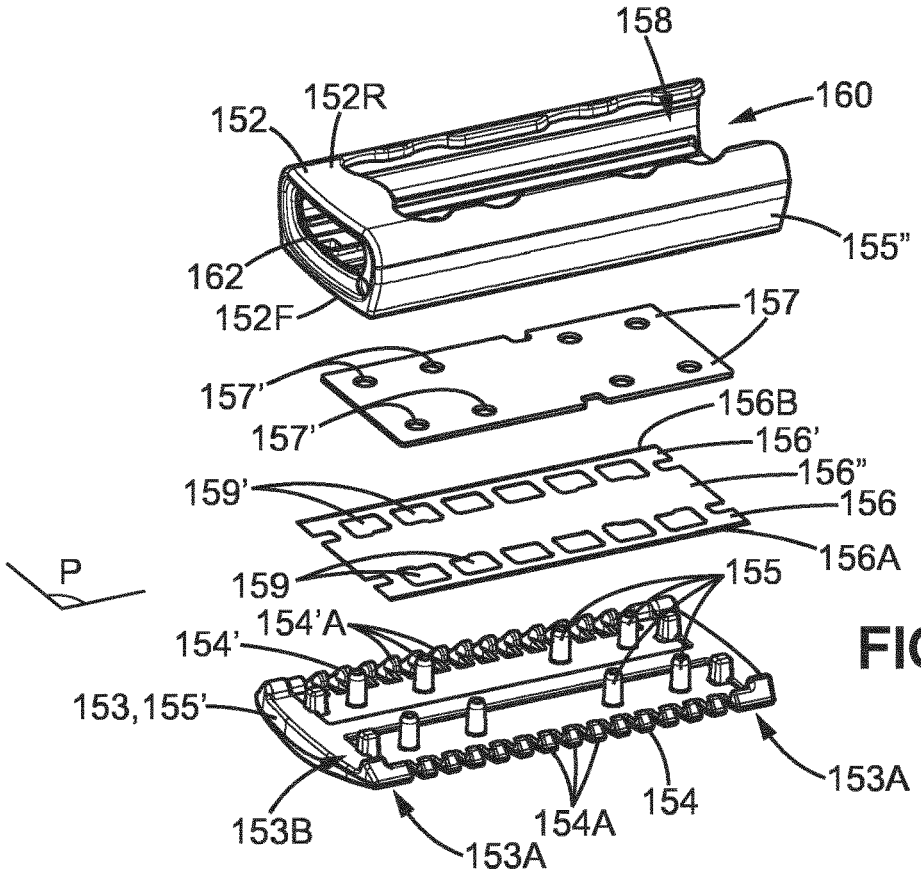
FIG. 7B is an exploded view of a protector according to another aspect of the disclosure.

According to aspects, as shown in FIGS. 7A and 7B, the securing pin member 155' may be provided on the cover 153. More precisely, the lower part 153B of the cover 153 may be provided with the securing pin member 155. The securing pin member 155 may, according to other aspects, be provided on the front face 152F of the housing 152 (not illustrated).

According to some aspects, the protector may include two trimming blades 156 and 156'. While the following description details a protector 15 having two trimming blades 156 and 156', one should understand that the details may also pertain to the protector 15 having only one trimming blade 156.

When the protector 15 is provided with two opposite trimming blade edges 156A and 156'A, two separate trimming blades 156 and 156A may also be provided, as depicted on FIG. 7A or a single trimming blade 156 may be provided, as depicted on FIG. 7B. According to some aspects, the protector having a single trimming blade 156 may further include a single double edge trimming blade 156" wherein the first trimming blade 156 and the second trimming blade 156' may be provided on the same side.

Referring to FIG. 7A, the securing pins 155 may be provided to receive the two trimming blades 156 and 156', and may thereby serve ensure a correct alignment of the trimming blades 156 and 156' after manufacturing. According to some aspects, a first series of securing pins 155 may be provided on the side of the first comb 154 to receive the first trimming blade 156 and a second series of securing pins 155 may be provided on the side of the second comb 154' to receive the second trimming blade 156'. The two series of securing pins 155 may be symmetrically opposed with respect to the longitudinal axis A.

Each trimming blade 156, 156' may be provided with blade apertures 159, 159' such that the trimming blade 156, 156' may be brought in alignment with said securing pins 155. The trimming blade (double edge trimming blade 156" or two opposite trimming blades 156 and 156') may be mounted on the securing pins 155 according to aspects including the steps of aligning the blade apertures 159, 159' with said securing pins 155, and passing the securing pins 155 passing through the trimming blade apertures 159, 159'.

According to further aspects, the method may include forming a crimping head 155A at one end of each securing pins 155, thereby irremovably riveting the trimming blade (double edge trimming blade 156" or two opposite trimming blades 156 and 156') onto the securing pin member 155'. After crimping, the trimming blade (double edge trimming blade 156" or two opposite trimming blades 156 and 156') may be irremovably fixed to the securing pin member 155'. Hence, the trimming blade (double edge trimming blade 156" or two opposite trimming blades 156 and 156') may not be detached easily (without the use of a tool) from the securing pin member 155'. Additionally, after crimping, the trimming blade (double edge trimming blade 156" or two opposite trimming blades 156 and 156') may not move with respect to the securing pin member 155'. Thus, the trimming blade (double edge trimming blade 156" or two opposite trimming blades 156 and 156') and the securing pin member 155' may be motionlessly secured and attached together.

According to further aspects, and after crimping, the first and second trimming blades 156 and 156' may be aligned in the same plane and the blade edge 156A and 156'A of each may be opposite to the longitudinal axis A. According to other aspects, the double edge trimming blade 156" may be attached in a similar manner.

Before the step of crimping the end of the securing pins 155, a securing apertures member 155" including securing apertures (not visible in the Figures) may be provided and may be disposed to be in alignment with the securing pins 155. The securing pins member 155' may then be mounted onto the trimming blade (double edge trimming blade 156" or two opposite trimming blades 156 and 156') by passing the securing pins 155 through the securing apertures 153' and forming a crimping head at one end of each securing pin 155, thereby irremovably riveting both the trimming blade (double edge trimming blade 156" or two opposite trimming blades 156 and 156') and the securing apertures member 155" onto the securing pins member 155'.

After crimping, the trimming blade (double edge trimming blade 156" or two opposite trimming blades 156 and 156') and the securing apertures member 155" may be irremovably fixed to the securing pin member 155'. Hence, the trimming blade (double edge trimming blade 156" or two opposite trimming blades 156 and 156') and the securing apertures member 155" may not be detached easily (without any tool) from the securing pin member 155'. Additionally, after the step of crimping, the trimming blade (double edge trimming blade 156" or two opposite trimming blades 156 and 156') may not move with respect to the securing pin member 155'. In other words, the trimming blade (double edge trimming blade 156" or two opposite trimming blades 156 and 156') and the securing pin member 155' may be substantially motionlessly secured and attached together. According to the shaving assembly (with a movable or motionless cover), the securing apertures member 155" may or may not be movable with respect to the trimming blade (double edge trimming blade 156" or two opposite trimming blades 156 and 156') and the securing pin member 155'.

According to some aspects, the securing apertures member 155" may be provided on the cover 153. When the comb 154, 154' is not movable, the crimping step may lead to a motionless fixation of the trimming blade 156, 156', the cover 153 and the housing 152. In other words, the trimming blade (double edge trimming blade 156" or two opposite trimming blades 156 and 156'), the cover 153 and the housing 152 may be non-movable with respect to one another. According to further aspects, the step of riveting the trimming blade (double edge trimming blade 156" or two opposite trimming blades 156 and 156') and the securing apertures member 155" onto the securing pins member 155' may further include step of fixedly attaching together the trimming blade (double edge trimming blade 156" or two opposite trimming blades 156 and 156'), the securing apertures member 155" and the securing pins member 155'. Accordingly, a wet shave razor 10, as depicted in FIGS. 1A-1B and 4A-4D may be formed.

When the comb 154, 154' is movable with respect to the housing 152, the securing apertures member 155" may be provided on the cover 153, whereas the securing pin member 155 may be provided on the front face 152F of the housing 152 (not illustrated). As such, the step of crimping may lead to a substantially motionless fixation of the trimming blade (double edge trimming blade 156" or two opposite trimming blades 156 and 156') and the housing 152 together, whereas the cover 153 may still be able to move with respect to the housing 152. According to further aspects, the step of riveting the trimming blade (double edge trimming blade 156" or two opposite trimming blades 156 and 156') and the securing apertures member 155" onto the securing pins member 155' may further include a step of fixedly attaching together the trimming blade (double edge trimming blade 156" or two opposite trimming blades 156 and 156') and the securing pins member 155', and movably attaching the trimming blade (double edge trimming blade 156" or two opposite trimming blades 156 and 156') and the securing pins member 155' onto the securing apertures member 155". The securing apertures 153' provided on the cover 153 may be shaped to retain the trimming blade (double edge trimming blade 156" or two opposite trimming blades 156 and 156') and the housing 152 while allowing a sliding movement of the cover 153 with respect to the housing 152. The securing apertures 153' may be shaped, for example, as oblong holes aligned with the oblique axis B in order to allow a motion of the cover 153 along that axis B when the user desires to adjust the trimming length L. Accordingly, a wet shaving razor 10 as depicted in FIGS. 2 and 5A-5D may be formed.

According to some aspects, a spacer 157 may be disposed directly between the trimming blade 156, 156' and the front face 152F of the housing 152 before crimping the end of the securing pins 155. The step of riveting may further include riveting together the trimming blade (double edge trimming blade 156" or two opposite trimming blades 156 and 156') and the spacer 157 onto the securing pins member 155'. The spacer 157 may be irremovably fixed to the securing pin member 155'. Thus, the spacer(s) 157, the trimming blade (double edge trimming blade 156" or two opposite trimming blades 156 and 156') and the securing apertures member 155" may not be detached easily (without any tool) from the securing pin member 155'. Additionally, after the step of crimping, the spacer(s) 157 and the trimming blade (double edge trimming blade 156" or two opposite trimming blades 156 and 156') may not move with respect to the securing pin member 155'.

The securing pins 155 may, for example, be over-molded onto the securing pin member 155' (i.e. the lower part 153B of the cover 153 or the front part 152F of the housing 152). As such, the securing pins 155 and the securing pin member 155' may be made of different materials. The material combinations may provide the advantage of hiding or enhancing the visibility of the trimming blade by changing the color or material type or by enhancing the trimming blades appearance such as, for example, by allowing the use of printing or in mold labeling of the securing pins 155 before being over-molded with the securing pin member 155'.

Figure 7C:
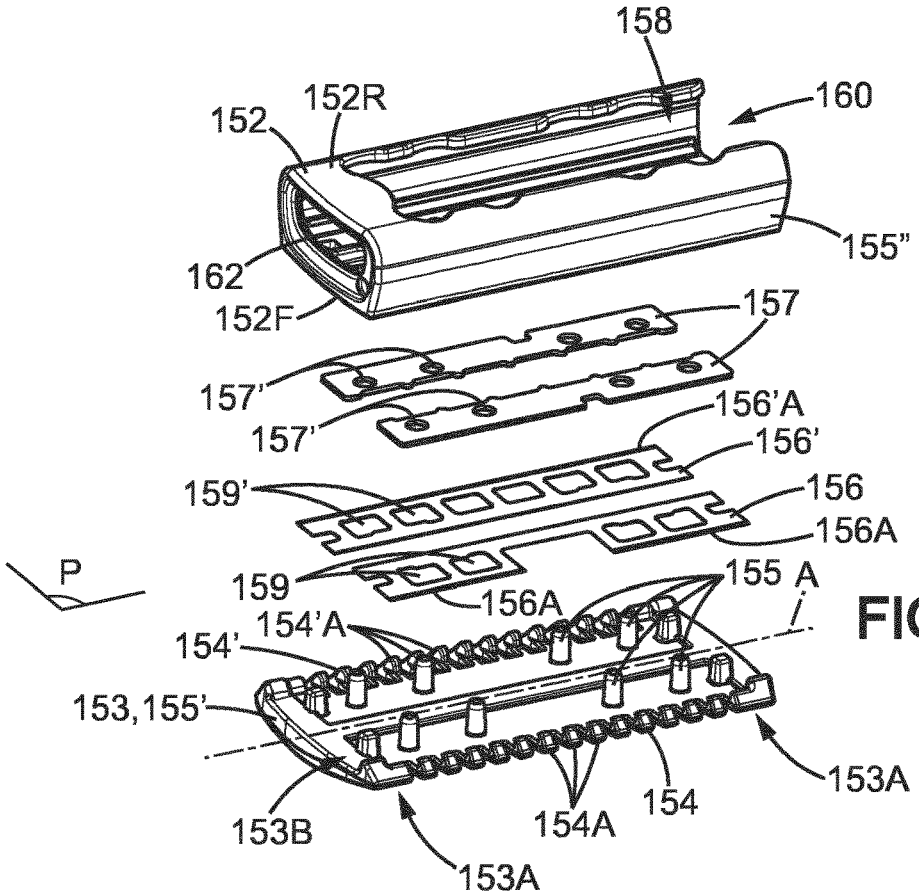
FIG. 7C is an exploded view of a protector according to another aspect of the disclosure.

According to some aspects, as shown in FIG. 7C, the edge of the trimming blade may not be continuous. As detailed in FIGS. 7A and 7B, the edge 156A, 156'A of the trimming blades 156 and 156' may be continuous thus the entire length of the trimming blade 156 may be capable of cut cutting. However, as detailed in FIG. 7C, only a part of the length of the trimming blade 156 may be capable of cutting. For example, the middle part of the blade may not be capable of cutting. As such, the user may be allowed to make a desired pattern when trimming. One should understand that the design of the cutting edge 156A of the trimming blade 155 may be different and according to a desired pattern. Several protectors 15 may also be used. According to further aspects, the cutting edge 156A of the trimming blade 156 on one side may be continuous, whereas the cutting edge 156A on the other side of the trimming blade 156 may be non-continuous. The design of the cutting edge 156 may be different or can be the same on both sides of the trimming blade 156. For example, as shown in FIG. 7C, the edge 156A of the trimming blade 156 may be non-continuous, whereas the edge 156'A of the trimming blade 156' may be continuous.

Figure 7D:
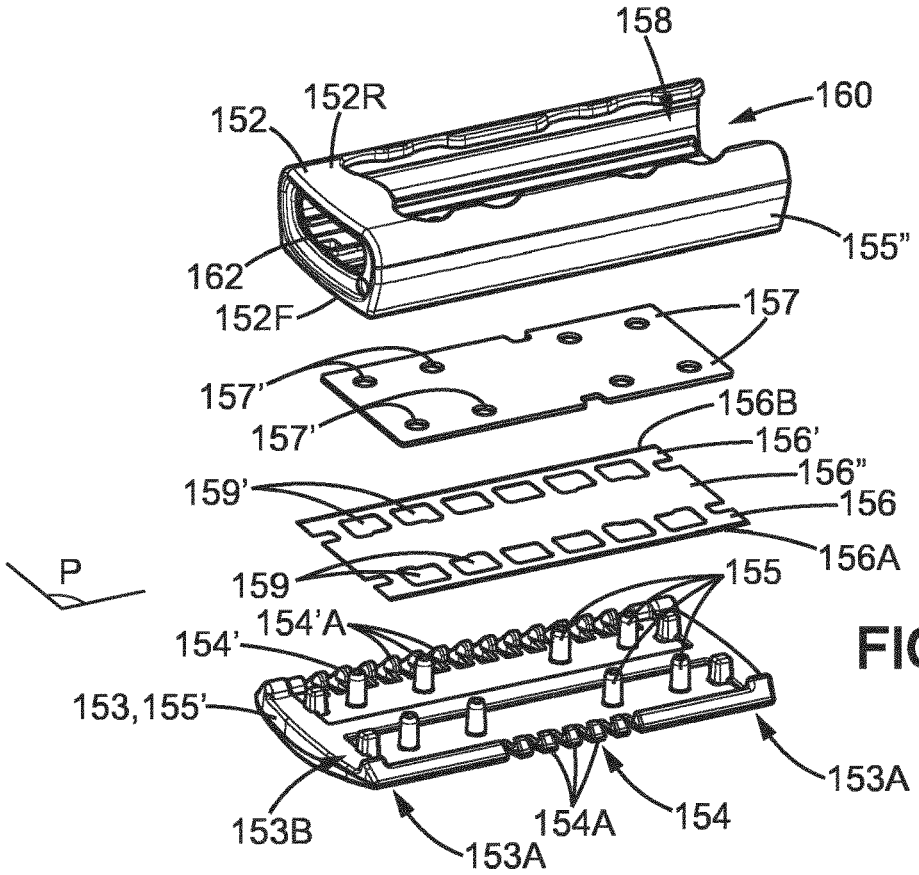
FIG. 7D is an exploded view of a protector according to another aspect of the disclosure.

According to some aspects, as shown in FIG. 7D, the teeth 154A and 154'A of the comb 154 may not be continuously spaced on the protector 15. FIGS. 7A-7C detail that the teeth 154A and 154'A are regularly spaced on the comb 154. Thus, more or less, of the entire length of the protector 15 may be provided with the comb 154. However, in FIG. 7D only a part of the length of the comb 154 is being provided with teeth 154A. For example, only the middle part of the protector 15 may be provided with teeth 154A. As such, the user may be able to make a desired pattern when trimming. One should understand that the design of the comb 154 may be different according to the desired pattern. Several protectors 15 may also be used. The comb 154 on one side may be continuous, whereas the comb 154 on the other comb 154 may be non-continuous. The design of the teeth 154A, 154'A may be different or may be the same on both sides of the comb 154. For example, the teeth 154A of the comb 154 may only be provided on the middle, whereas the teeth 154'A of the comb 154' may be provided, more or less, along the entire length of the comb 154'. One should understand that there may be multiple combinations of the shape of the cutting edge 156A, 156'A of the trimming blade 156, 156' and/or the shape of the combs 154, 154'. Different shapes of cutting edge 156A, 156'A may be combined with different shapes of the comb 154, 154'.

According to some aspects, the razor 10 may be disposable or may be a razor system 10 in which the razor cartridge 14 may be thrown away when the shaving edge 16A of the razor blade(s) 16 may be dulled. For example, the razor cartridge 14 may be a disposable razor cartridge 14 including a lock/release mechanism (not depicted) may enable selective connection of the razor cartridge 14 to the razor handle 12 or release of the razor cartridge 14 in order to exchange razor cartridges 14.

As shown in FIGS. 4A-4C, 5A-5C and 6, the rear face 14D of the razor cartridge 14 may include two connecting members or rearwardly protruding connectors, such as for example, two inwardly facing arcuate slots 28 shaped in correspondence with and adapted to receive lateral edges of shell bearings (not shown) provided onto the razor handle 12 for pivotally mounting the razor cartridge 14 onto the razor handle 12.

According to further aspects, the handle body 18 may be provided with flexible gripping areas made of an injected molded elastomeric material to improve gripping of the razor handle 12 during trimming According to other aspects, the remainder of the handle 18 may be a substantially rigid injected molded thermoplastic or non-elastomeric material.

According to some aspects, a razor 10, may allow a user to be able to shave selectively either with the razor blades 16, when the protector 15 is released from the razor cartridge 14 or with the trimming blade 156 when the protector 15 is covering the razor cartridge 14.

Hence, according to a shaving manner in which the protector 15 may be removed from the razor cartridge 14, the user may shave "traditionally" with the razor cartridge 14 in using the main razor blade(s) 16. When the protector 15 may already be covering the razor cartridge 14, the user may simply just slide the protector 15 from the razor cartridge 14 and shave.

According to a trimming manner in which the protector 15 may be covering the razor cartridge 14, the user may trim hair to a given length with the trimming blade (sole trimming blade 156, double edge trimming blade 156" or two opposite trimming blades 156 and 156') and a corresponding comb 154, 154'. As such, if the protector is not already mounted onto the cartridge, the user may merely slide the protector 15 onto the razor cartridge 14. According to aspects where the trimming length may not correspond to a desired length, the user may simply adjust the trimming length L by changing the height of the teeth 154A, 154'A. Accordingly, the user may select a comb 154, 154' on a protector 15 and/or move the cover 153 onto the housing 152 and/or change the protector 15.

The material combinations used for the cover 153, the trimming blade 165, 156' and/or the housing 152 may provide the advantage of hiding or enhancing the visibility of the trimming blade 156, 156' and thus providing an indication of the trimming length L.

The invention claimed is:

1. A protector for a razor cartridge comprising:

a housing extending longitudinally along a longitudinal axis and having a first front face and an opposing rear face;

a cover movably coupled with the housing, the cover having a first face and an opposing second face; the cover including a first comb and a second comb;

the first comb having a plurality of first teeth, the first comb being located in a first region of the cover such that the plurality of first teeth extend outward to form the first face of the cover, each of the first teeth having a height that defines a first trimming length;

a first trimming blade having a first cutting edge, the first trimming blade being disposed on the front face of the housing, being accessible through the first comb, and extending along the longitudinal axis, and the second comb having a plurality of second teeth, the second comb being located in a second region of the cover such that the plurality of second teeth extend outward to form the second face of the cover, each of the second teeth having a height that defines a second trimming length;

a second trimming blade having a second cutting edge, the second trimming blade being disposed on the front face of the housing, being accessible through the second comb, and extending along the longitudinal axis opposite first trimming blade;

the first teeth of the first comb projecting away from the first cutting edge in a first direction transverse to the longitudinal axis, and the second teeth of the second comb projecting away from the second cutting edge in a second direction opposite the first direction transverse to the longitudinal axis, wherein the cover is movable in relation to the housing transverse to the longitudinal axis and in a plane parallel to the first and second directions to change the first trimming length and/or the second trimming length.

2. The protector according to claim 1, wherein the first trimming blade is disposed between the cover and the front face of the housing.

3. The protector according to claim 1, wherein the teeth of the first and second combs have a height varying along an oblique axis.

4. The protector according to claim 3, wherein a height of the teeth of the first comb is different from a height of the teeth of the second comb.

5. The protector according to claim 1, wherein the first trimming blade and the second trimming blade are provided on a single double edge trimming blade.

6. The protector according to claim 1, wherein the rear face of the housing is provided with a rear opening, the rear opening being configured to allow for a razor handle to extend through the rear opening to couple with a connecting member of a razor cartridge.

7. The protector according to claim 1, wherein a height of the teeth of the first comb is different from a height of the teeth of the second comb.

8. The protector according to claim 1, wherein an upper part of the cover includes a plurality of equidistantly spaced members extending transverse to the longitudinal axis, opposing ends of each of the members connecting the teeth of the first comb and the teeth of the second comb.

9. The protector according to claim 1, wherein the movement of the cover in relation to the housing provides a plurality of varying trimming lengths of the first trimming length and a corresponding plurality of varying trimming lengths of the second trimming length.

10. The protector according to claim 1, wherein the movement of the cover in relation to the housing is such that the first comb is moved relative to the first trimming blade and the second comb is moved relative to the second trimming blade.

11. A shaving assembly including a razor cartridge and a protector according to claim 1, the razor cartridge including one or more razor blades, each having a cutting edge, wherein the protector covers at least the cutting edge of the one or more razor blades.

12. The shaving assembly according to claim 11, wherein the protector includes an opening, the razor cartridge being mounted in the opening and covering the razor cartridge.

13. A wet shaving razor having a razor handle and a shaving assembly according to claim 11, the razor cartridge being attached to the razor handle, wherein the rear face of the housing is provided with a rear opening, and wherein the razor handle extends through the rear opening.

14. A method of using the wet shaving razor according to claim 13, including the steps of:

removing the protector from the razor cartridge and shaving, and placing the protector onto the razor cartridge and using at least the first trimming blade to trim body hair with the protector covering the razor cartridge.

15. The method according to claim 14, further including the step of adjusting the trimming length by changing the position of the cover to change the height of the teeth in front of the cutting edge of each trimming blade.

* * * * *